US010569554B2

(12) United States Patent
Takino

(10) Patent No.: US 10,569,554 B2
(45) Date of Patent: Feb. 25, 2020

(54) LIQUID EJECTING APPARATUS

(71) Applicant: SEIKO EPSON CORPORATION, Tokyo (JP)

(72) Inventor: Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/022,618

(22) Filed: Jun. 28, 2018

(65) Prior Publication Data

US 2019/0001685 A1 Jan. 3, 2019

(30) Foreign Application Priority Data

Jun. 29, 2017 (JP) ..... 2017-127038

(51) Int. Cl.
*B41J 2/165* (2006.01)
*B41J 11/00* (2006.01)
*B41J 3/54* (2006.01)

(52) U.S. Cl.
CPC ..... *B41J 2/16588* (2013.01); *B41J 2/16508* (2013.01); *B41J 3/543* (2013.01); *B41J 11/007* (2013.01); *B41J 11/0095* (2013.01); *B41J 2/16517* (2013.01)

(58) Field of Classification Search
CPC ..... B41J 2/16508; B41J 2/16588; B41J 11/0095; B41J 11/007; B41J 3/543; B41J 29/38; B41J 2/185; B41J 2002/1853; B41J 2002/1856; B41J 2/16517; B41J 2002/1657
See application file for complete search history.

(56) References Cited

U.S. PATENT DOCUMENTS 7,316,477 B2 * 1/2008 Yoda ..... B41J 11/0025 271/198
8,845,053 B2 * 9/2014 Hirosawa ..... B41J 2/16526 347/12
8,911,045 B2 * 12/2014 Sato ..... B41J 2/16505 347/14
2008/0238972 A1 10/2008 Yoda

FOREIGN PATENT DOCUMENTS

JP 2001-113690 A 4/2001
JP 2005-103884 A 4/2005
JP 2006-264180 A 10/2006
JP 2007-076872 A 3/2007
JP 2008-265287 A 11/2008
JP 2015-193196 A 11/2015

* cited by examiner

*Primary Examiner* — Thinh H Nguyen
(74) *Attorney, Agent, or Firm* — Workman Nydegger

(57) ABSTRACT

A liquid ejecting apparatus includes a liquid ejecting head that prints an image on a medium, by ejecting a liquid through nozzles, a transport belt that transports the medium, at a position opposite the liquid ejecting head, a moving mechanism that moves the transport belt in a width direction, and a control unit that controls the moving mechanism. The liquid ejecting head includes a first nozzle group and a second nozzle group. The control unit controls the moving mechanism such that a nozzle group performing the preliminary ejection which is an ejection of the liquid not uninvolved in printing among the first nozzle group and the second nozzle group is located at a position not facing the transport belt, and a nozzle group that does not perform the preliminary ejection is located at a position facing the transport belt.

5 Claims, 6 Drawing Sheets

LIQUID EJECTING APPARATUS

BACKGROUND

1. Technical Field

The present invention relates to a liquid ejecting apparatus that ejects a liquid onto a medium transported by a transport belt.

2. Related Art

For example, JP-A-2008-265287 discloses a liquid ejecting apparatus configured as above. The liquid ejecting apparatus includes two transport units shifted from each other in the transport direction of the medium, one on the upstream side and the other on the downstream side, a head unit including a plurality of ink jet heads alternately positioned in the transport direction of the medium and in a width direction intersecting the transport direction, and a maintenance unit including a plurality of caps, located so as to correspond to the respective ink jet heads.

The transport units each include a plurality of transport belts that transport the medium by moving in the transport direction of the medium. The plurality of transport belts are aligned with a predetermined clearance therebetween, in the width direction intersecting the transport direction, such that the transport belts of the upstream transport unit and those of the downstream transport unit are alternately located in the width direction.

At the time of maintenance, the head unit is moved to a position on the upper side of the plurality of caps, each located between the transport belts in the width direction, such that the plurality of ink jet heads, thus far located right above the respective transport belts, are each located between the transport belts, in the width direction. Then the liquid is discharged as waste liquid from the ink jet heads, now located so as to oppose the respective caps in the up-down direction, as a maintenance operation of the ink jet head.

In the conventional liquid ejecting apparatuses, however, the upstream transport unit and the downstream transport unit are located at different positions in the transport direction of the medium, and therefore a space for the two transport units to be aligned in the transport direction of the medium has to be secured, which results in an increase in dimensions of the apparatus as a whole.

SUMMARY

An advantage of some aspects of the invention is provision of a liquid ejecting apparatus, configured to suppress an increase in dimensions of the apparatus as a whole, while shortening the time required for maintenance.

In an aspect, the invention provides a liquid ejecting apparatus including a liquid ejecting head that prints an image on a medium, by ejecting a liquid through a plurality of nozzles according to print data, a transport belt that transports the medium by moving in a transport direction of the medium, at a position opposite the liquid ejecting head, a moving mechanism configured to move at least one of the liquid ejecting head and the transport belt in a width direction intersecting the transport direction, and a control unit that controls the moving mechanism. The liquid ejecting head includes a first nozzle group including a plurality of the nozzles, and a second nozzle group including another plurality of the nozzles than the nozzles of the first nozzle group, the second nozzle group being located at a position shifted from the first nozzle group in the width direction. The control unit controls the moving mechanism, when one of the first nozzle group and the second nozzle group that performs preliminary ejection, including ejecting the liquid uninvolved in printing, is located at a position deviated from the transport belt, so as to locate the other nozzle group that does not perform the preliminary ejection, at a position opposite the transport belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereafter, a liquid ejecting apparatus according to a first embodiment will be described, with reference to the drawings. The liquid ejecting apparatus according to this embodiment is configured as an ink jet printer that performs printing by ejecting an ink, exemplifying the liquid in the invention, onto a recording sheet exemplifying the medium in the invention. In addition, the mentioned ink jet printer is what is known as a line-head printer, in which a liquid ejecting head including a plurality of nozzles arranged so as to cover an entire width intersecting the transport direction of the recording sheet, is fixedly installed, so as to perform the printing by ejecting the ink through the liquid ejecting head, onto the recording sheet transported through a position opposite the liquid ejecting head.

Figure 1:
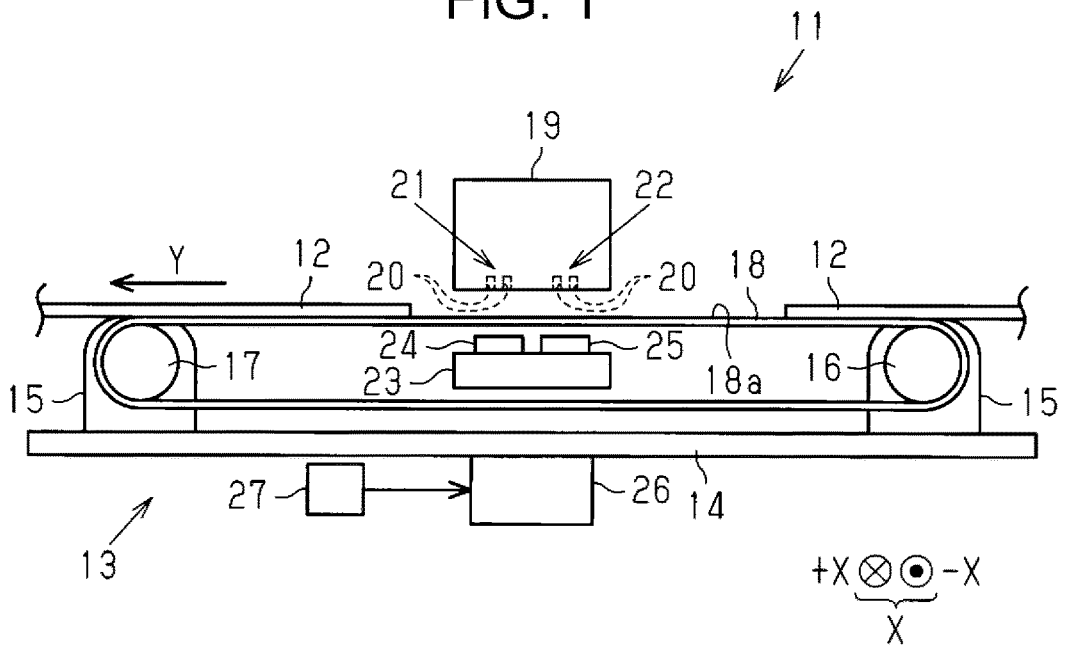
FIG. 1 is a schematic front view showing a general configuration of a liquid ejecting apparatus according to a first embodiment.
Figure 2:
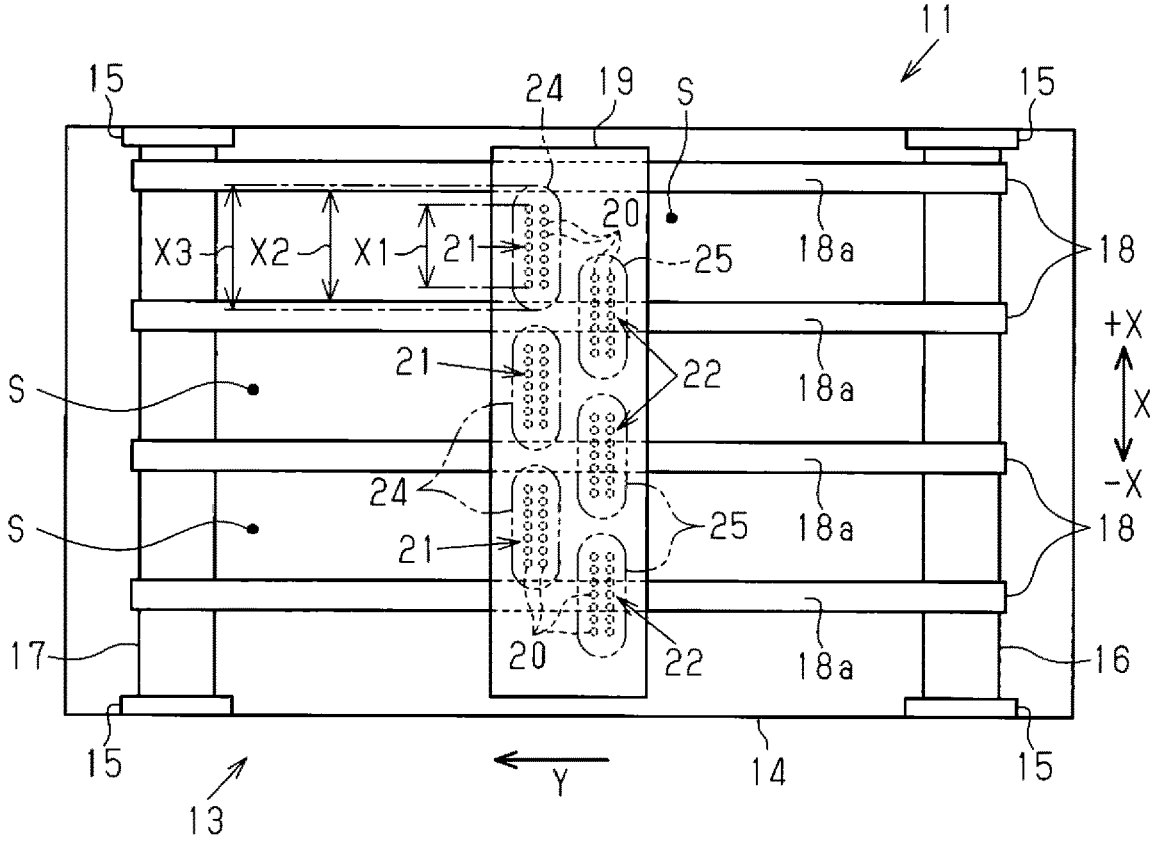
FIG. 2 is a schematic plan view showing the general configuration of the liquid ejecting apparatus.

As shown in FIG. 1 and FIG. 2, the liquid ejecting apparatus 11 includes a transport unit 13 configured to transport a recording sheet 12, exemplifying the medium in the invention, to the left in FIG. 1, as indicated by an arrow Y. The transport unit 13 includes a substrate 14 having a rectangular shape in a plan view from above, and a bearing portion 15 is provided at each of the four corners of the substrate 14, so as to form a pair in a width direction X of the recording sheet 12, which intersects the transport direction Y. A drive roller 16, to be driven to rotate by a non-illustrated transport motor, is supported between the pair of bearing portions 15 on a relatively upstream side in the transport direction Y. Between the pair of bearing portions 15 on a relatively downstream side in the transport direction Y, a slave roller 17, set to freely rotate about an axial line parallel to that of the drive roller 16, is supported. A plurality of endless transport belts 18 are bridged between the drive roller 16 and the slave roller 17, to be made to circulate when the drive roller 16 rotates.

The outer circumferential surface of the transport belt 18, corresponding to the surface oriented upward when the transport belt 18 runs in the transport direction Y in FIG. 1, serves as a supporting surface 18*a* that supports the recording sheet 12. When the recording sheet 12 is supported by the supporting surface 18*a*, the recording sheet 12 and the transport belt 18, charged by a non-illustrated charging mechanism, are electrostatically adsorbed to each other. Accordingly, when the supporting surface 18*a* of the transport belt 18 is moved in the transport direction Y by the rotation of the drive roller 16, the recording sheet 12 mounted on the supporting surface 18*a* is transported in the transport direction Y.

As shown in FIG. 2, a plurality (in this embodiment, four as an example) of transport belts 18 are aligned in the width direction X of the recording sheet 12, at regular intervals. The plurality of transport belts 18 are oriented along the transport direction Y, with a clearance S between the transport belts 18 adjacent to each other in the width direction X, the clearance S being wider than the length of the transport belt 18 in the width direction X (belt width). At a position above the plurality of transport belts 18, a liquid ejecting head 19 of a line head type, having a width that matches the width of the recording sheet 12, is fixed such that the longitudinal side is oriented in the width direction X.

The liquid ejecting head 19 includes a plurality of nozzles 20, located on a surface opposing the supporting surface 18*a* of the transport belt 18 that transports the recording sheet 12, in other words the lower surface in FIG. 1. Some (schematically seven in FIG. 2) of the plurality of nozzles 20 are aligned in the width direction X, so as to form a nozzle row. The liquid ejecting head 19 includes one or more (in FIG. 2, four as an example) nozzle rows. In addition, the liquid ejecting head 19 includes nozzle groups 21 and 22, each including a plurality of nozzles 20 that form the nozzle row.

The plurality of nozzle groups 21 and 22 are classified into first nozzle groups 21 located on the relatively downstream side in the transport direction Y of the recording sheet 12, and second nozzle groups 22 located on the relatively upstream side. The second nozzle groups 22 each include another plurality of nozzles 20 than the plurality of nozzles 20 forming the first nozzle group 21. Three of the first nozzle groups 21 are aligned in the width direction X, at predetermined intervals therebetween, and also three of the second nozzle groups 22 are aligned in the width direction X, at predetermined intervals therebetween.

As shown in FIG. 2, the first nozzle groups 21 and the second nozzle groups 22 are shifted from each other in the width direction X, so as to be alternately located in the width direction X. Thus, the first nozzle groups 21 and the second nozzle groups 22 are shifted from each other both in the transport direction Y and in the width direction X, of the recording sheet 12. Further, the nozzle rows including the plurality of nozzles 20 forming the first nozzle group 21, and the nozzle rows including the plurality of nozzles 20 forming the second nozzle group 22, are located such that a part of the nozzles 20, located at respective end portions of the nozzle rows in the width direction X, overlap in the transport direction Y.

As shown in FIG. 1 and FIG. 2, a cap holder 23 is fixed, via a non-illustrated frame, at a position right under the liquid ejecting head 19 and on the lower side of the supporting surface 18*a* of the transport belt 18. On the upper face of the cap holder 23, a plurality of first caps 24 and a plurality of second caps 25, serving as maintenance components, are provided. The first caps 24 are located at three positions right under the respective first nozzle groups 21 of the liquid ejecting head 19. Likewise, the second caps 25 are located at three positions right under the respective second nozzle groups 22 of the liquid ejecting head 19.

When the maintenance work for the liquid ejecting head 19 is required, for example when the ink in the nozzle 20 is thickened, the thickened ink is discharged as waste liquid, from the plurality of nozzles 20 forming the first nozzle group 21 onto the first caps 24 located right thereunder. Likewise, the thickened ink is discharged as waste liquid, from the plurality of nozzles 20 forming the second nozzle group 22 onto the second caps 25 located right thereunder. Thus, at the time of the maintenance of the liquid ejecting head 19, a preliminary ejection, including discharging the ink uninvolved with printing from the nozzles 20 constituting each of the nozzle groups 21 and 22, is performed.

As shown in FIG. 2, a length X1 of each of the three nozzle groups 21 (22) constituting the first nozzle groups 21 (second nozzle groups 22) in the width direction X is shorter than a length X2 of the clearance S in the width direction X, between the transport belts 18 adjacent to each other in the width direction X. In addition, the length X2 of the clearance S in the width direction X is shorter than a length X3 of the opening of the first cap 24 (second cap 25) in the width direction X. In FIG. 2, the first nozzle groups 21 are located so as to correspond to the clearance S between the transport belts 18, in other words deviated from the transport belt 18, so that the preliminary ejection can be performed onto the first caps 24 located thereunder. In contrast, in FIG. 2 the second nozzle groups 22 are each located so as to oppose the transport belt 18, and is restricted from performing the preliminary ejection onto the second cap 25 located thereunder.

As shown in FIG. 1, a moving mechanism 26, configured to move the substrate 14 of the transport unit 13 in the width direction X, is provided under the substrate 14. The moving mechanism 26 includes, for example, a non-illustrated rack and pinion mechanism or a cylinder mechanism, so as to move the substrate 14 in the width direction X according to control data from a control unit 27 that integrally controls the liquid ejecting apparatus 11. Thus, the moving mechanism 26 is configured to move the transport belts 18 to a +X side or a −X side in the width direction X, by moving the substrate 14 under the control of the control unit 27.

Hereunder, the working of the liquid ejecting apparatus 11 configured as above will be described, focusing on the preliminary ejection performed at the time of the maintenance of the liquid ejecting head 19. Here, since the preliminary ejection is for ejecting the ink uninvolved with the printing on the recording sheet 12, it will be assumed that the recording sheet 12 is not supported by the supporting surface 18*a* of the transport belt 18, when the preliminary ejection is performed.

When the ink in the nozzles 20 of the liquid ejecting head 19 is thickened, at least one of the liquid ejecting head 19 and the transport belt 18 is moved in the width direction X of the recording sheet 12, such that the nozzle groups 21 and 22 including the mentioned nozzles 20 are located above the clearance S between the transport belts 18 adjacent to each other in the width direction X. In this embodiment, the moving mechanism 26 moves the substrate 14 under the control of the control unit 27, thus to move the transport belts 18 in the width direction X. Here, not only the transport belts 18, but also the liquid ejecting head 19 may be moved in the width direction X, or only the liquid ejecting head 19 may be moved in the width direction X.

When the preliminary ejection for the maintenance of the liquid ejecting head 19 is to be started from the nozzles 20 of the first nozzle groups 21, the moving mechanism 26 moves the transport belts 18 in the width direction X such that the first nozzle groups 21 are located above the clearance S between the transport belts 18, as shown in FIG. 2. Then in the mentioned state, the ink is discharged as waste liquid from the nozzles 20 of the first nozzle groups 21 to the first caps 24 located thereunder, according to the control data from the control unit 27. Thus, the preliminary ejection is performed from the nozzles 20 of the first nozzle groups 21, onto the first caps 24.

Figure 3:
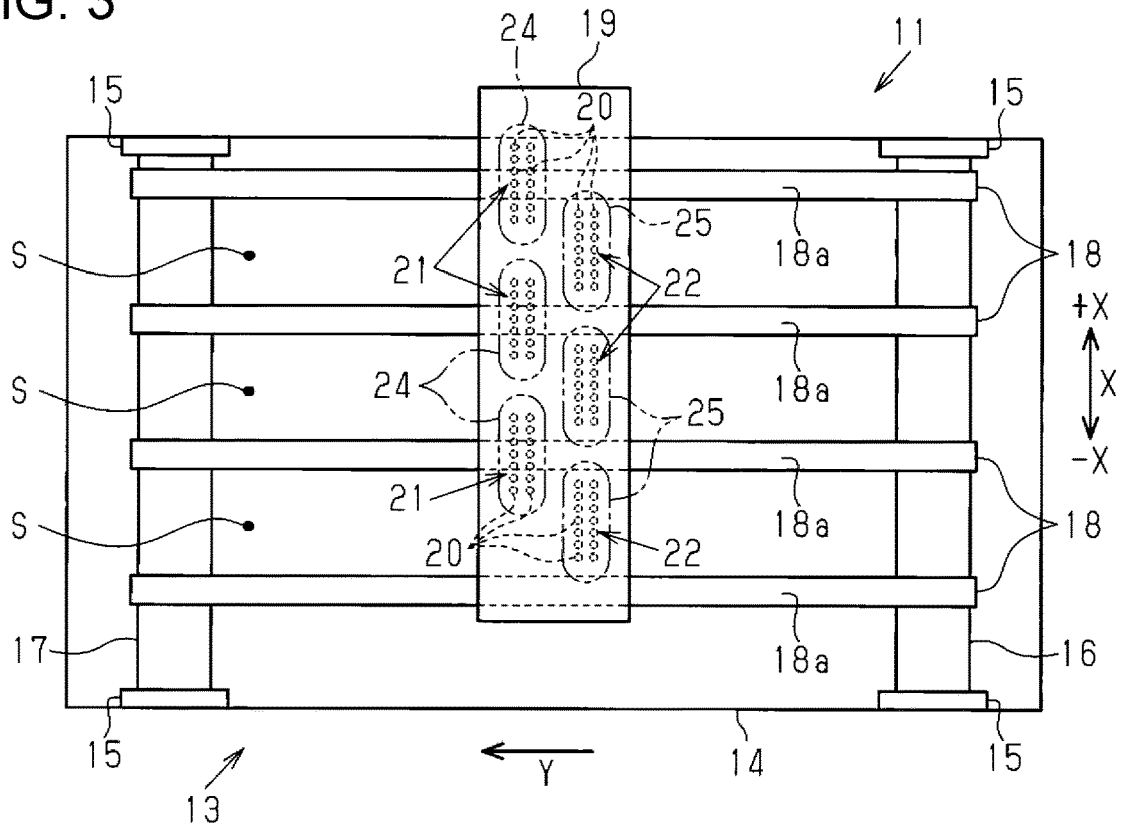
FIG. 3 is a plan view of the liquid ejecting apparatus, with transport belts moved to a −X side from the state shown in FIG. 2.

Referring now to FIG. 3, then the moving mechanism 26 moves the transport belts 18, together with the substrate 14 in the width direction X under the control of the control unit 27, such that the second nozzle groups 22 are located above the clearance S between the transport belts 18. In other words, the moving mechanism 26 moves the transport belt 18 to the −X side in the width direction X, from the state shown in FIG. 2. Then in the mentioned state, the ink is discharged as waste liquid from the nozzles 20 of the second nozzle groups 22 to the second caps 25 located thereunder, according to the control data from the control unit 27. Thus, the preliminary ejection is performed from the nozzles 20 of the second nozzle groups 22, onto the second caps 25.

Then, the moving mechanism 26 moves the transport belts 18 together with the substrate 14 in the width direction X, under the control of the control unit 27. In other words, the moving mechanism 26 moves the transport belts 18 in the width direction X, so that the relative positional relationship between the liquid ejecting head 19 and the transport belts 18 is returned to the state shown in FIG. 2, from the state shown in FIG. 3. After the state shown in FIG. 2 is reinstated, the transport of the recording sheet 12 by the transport belts 18 is resumed, and the ink is ejected onto the recording sheet 12 from the nozzles 20 of each of the nozzle groups 21 and 22 included in the liquid ejecting head 19, according to the print data. Thus, the printing is resumed.

The first embodiment provides the following advantageous effects.

1-1

The preliminary ejection can be performed, simply by moving the transport belt 18 in the width direction X, so as to locate the nozzle groups 21 and 22 that perform the preliminary ejection, at a position deviated from the transport belt 18. More specifically, at the position opposite the transport belt 18, the preliminary ejection is unable to be performed onto the caps 24 and 25, which are the maintenance components, because of the presence of the transport belt 18. However, at a position deviated from the transport belt 18, the preliminary ejection can be performed onto the caps 24 and 25 from the nozzle groups 21 and 22. Therefore, the time required for the maintenance can be shortened, compared with the case where the entirety of the liquid ejecting head 19 is moved in the width direction X for the purpose of the preliminary ejection, so that all the nozzle groups 21 and 22 are moved from the position opposite the transport belt 18 to the position on the outer side of the transport belt 18, thus to be deviated therefrom. In addition, in the transport unit 13 does not include the upstream transport belt and the downstream transport belt, which are shifted from each other in the transport direction Y, and therefore an increase in dimensions of the apparatus as a whole can be suppressed.

1-2

The preliminary ejection can be performed, simply by moving the transport belt 18 in the width direction X, so as to locate the nozzle groups 21 and 22 that perform the preliminary ejection at the position opposite the clearance S between the transport belts 18 adjacent to each other, in the width direction X. In other words, it suffices to move the transport belt 18 by a short distance, such that the nozzle groups 21 and 22, located at the position opposite the transport belt 18 before the preliminary ejection, are positioned so as to oppose the clearance S between the transport belts 18 adjacent to each other in the width direction X. Such an arrangement further shortens the time required for the maintenance.

Second Embodiment

Hereunder, the liquid ejecting apparatus 11 according to a second embodiment will be described, with reference to the drawings. The second embodiment is similar to the first embodiment in the configuration of the liquid ejecting head 19 and other components, except for the transport belt 18. Accordingly, the following description will focus on the differences from the first embodiment.

Figure 4:
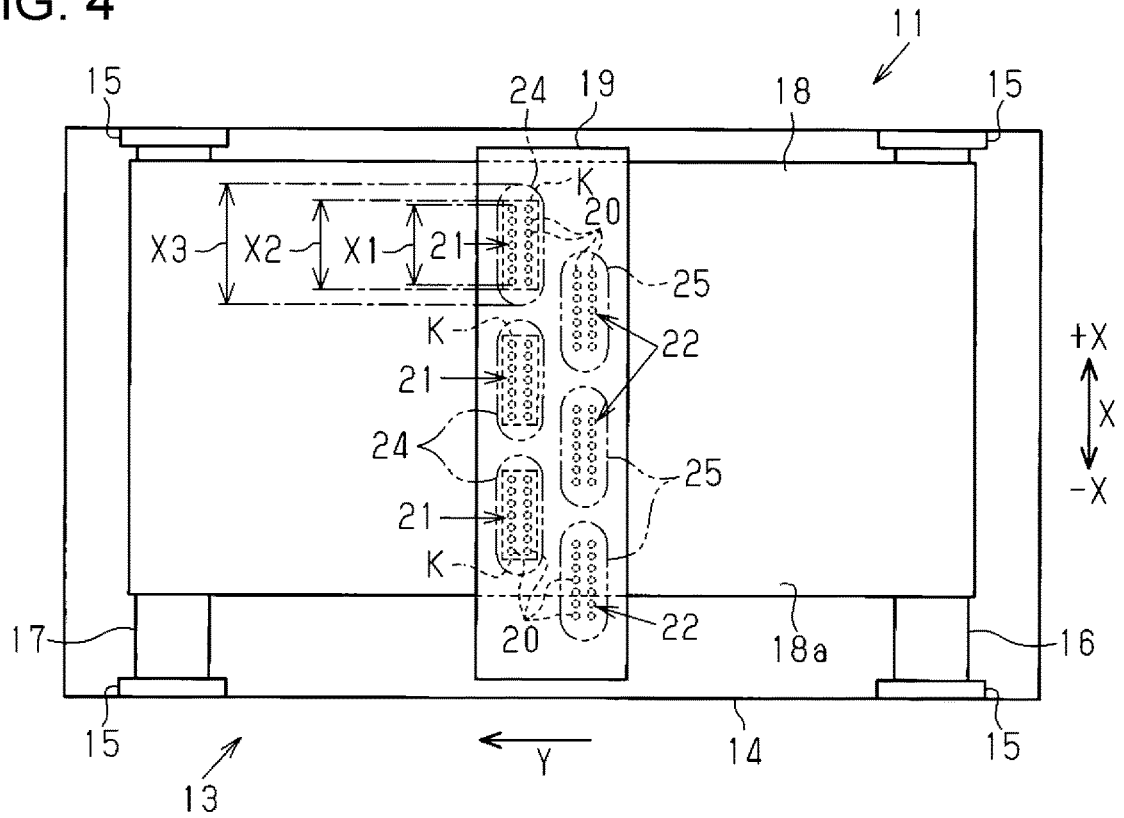
FIG. 4 is a schematic plan view showing a general configuration of a liquid ejecting apparatus according to a second embodiment.

As shown in FIG. 4, the transport belt 18 in the liquid ejecting apparatus 11 according to this embodiment is formed of an endless belt material, having a length in the width direction X (belt width) slightly shorter than the length of the liquid ejecting head 19 in the width direction X. In other words, the transport belt 18 according to this embodiment is formed of a single and wide belt material, unlike the plurality of transport belts 18 of the first embodiment. In addition, the wide transport belt 18 includes, as indicated by broken lines in FIG. 4, a plurality (in this embodiment, three) of plurality of openings K, formed at intervals generally the same as the intervals between the nozzle groups 21 (22) and between the caps 24 (25) in the width direction X.

The openings K each have a rectangular shape in a plan view, and a length X2 thereof in the width direction X is longer than the length X1 of the nozzle group 21 (22) in the width direction X, and shorter than the length X3 of the cap (25) in the width direction X. In FIG. 4, the first nozzle groups 21 are located so as to oppose the respective openings K, not the transport belt 18, and can therefore perform the preliminary ejection onto the first cap 24 located thereunder, through the opening K. In contrast, in FIG. 4 the second nozzle groups 22 are located so as to oppose the transport belt 18, not the opening K, and are therefore restricted from performing the preliminary ejection onto the second cap 25 located thereunder.

In this embodiment also, the transport belt 18 is moved in the width direction X and the transport direction Y, such that the first nozzle groups 21 are located above the respective openings K of the transport belt 18 as shown in FIG. 4, when the preliminary ejection for the maintenance of the liquid ejecting head 19 is to be started from the nozzles 20 of the first nozzle groups 21. More specifically, the drive roller 16 is made to rotate by the non-illustrated transport motor, under the control of the control unit 27, to move the transport belt 18 such that the openings K of the transport belt 18 are aligned with the respective first nozzle groups 21, in the transport direction Y.

Further, the moving mechanism 26 moves the transport belt 18 by moving the substrate 14, in the width direction X, under the control of the control unit 27. Accordingly, the openings K of the transport belt 18 are positioned so as to oppose the respective first nozzle groups 21, both in the transport direction Y and in the width direction X. Then in the mentioned state, the ink is discharged as waste liquid from the nozzles 20 of the first nozzle groups 21 to the first caps 24 located thereunder, through the openings K, according to the control data from the control unit 27. Thus, the preliminary ejection is performed from the nozzles 20 of the first nozzle groups 21, onto the first caps 24.

Figure 5:
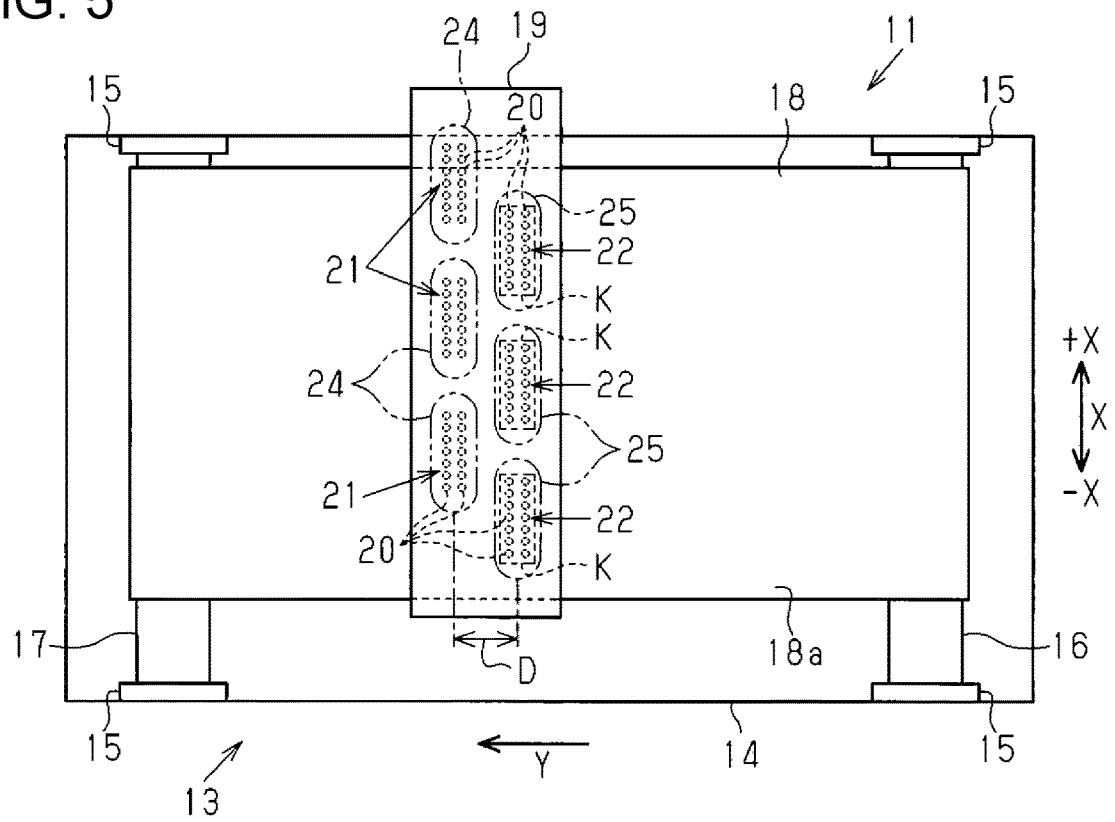
FIG. 5 is a schematic plan view of the liquid ejecting apparatus, with the transport belts moved to the −X side from the state shown in FIG. 4.

Referring now to FIG. 5, then the transport belt 18 is moved such that the second nozzle groups 22 are located above the respective openings K of the transport belts 18. First, the drive roller 16 is made to reversely rotate by the reverse rotation of the non-illustrated transport motor under the control of the control unit 27, to reversely move the transport belt 18 such that the supporting surface 18*a* moves in the direction opposite to the transport direction Y of the recording sheet 12. To be more detailed, the supporting surface 18*a* is made to move in the direction opposite to the transport direction Y, by a distance corresponding to an interval D between the first nozzle group 21 and the second nozzle group 22 in the transport direction Y.

Then the moving mechanism 26 moves the transport belt 18, together with the substrate 14, to the −X side in the width direction X under the control of the control unit 27, as shown in FIG. 5. Then in the mentioned state, the ink is discharged as waste liquid from the nozzles 20 of the second nozzle groups 22 to the second caps 25 located thereunder, through the openings K, according to the control data from the control unit 27. Thus, the preliminary ejection is performed from the nozzles 20 of the second nozzle groups 22, onto the second caps 25.

Then, the moving mechanism 26 moves the transport belt 18 together with the substrate 14 to the +X side in the width direction X, under the control of the control unit 27. In other words, the moving mechanism 26 moves the transport belt 18 in the width direction X, so that the relative positional relationship between the liquid ejecting head 19 and the transport belt 18 is returned to the state shown in FIG. 4, from the state shown in FIG. 5. After the state shown in FIG. 4 is reinstated, the transport of the recording sheet 12 by the transport belt 18 is resumed, and the ink is ejected onto the recording sheet 12 from the nozzles 20 of each of the nozzle groups 21 and 22 included in the liquid ejecting head 19, according to the print data. Thus, the printing is resumed.

The second embodiment provides the following advantageous effects, in addition to 1-1 above provided by the first embodiment.

2-1

The preliminary ejection can be performed, simply by moving the transport belt 18 in the width direction X and the transport direction Y, so as to locate the nozzle groups 21 and 22 that perform the preliminary ejection at the position opposite the respective openings K of the transport belt 18. In other words, it suffices to relatively move the nozzle groups 21 and 22, located at the position opposite the transport belt 18 and deviated from the openings K before the preliminary ejection, to the position opposite the openings K, by a short distance within the width of the transport belt 18, in the width direction X and the transport direction Y. Such an arrangement further shortens the time required for the maintenance.

Third Embodiment

Hereunder, the liquid ejecting apparatus 11 according to a third embodiment will be described, with reference to the drawings. The third embodiment is similar to the first embodiment in the configuration of the liquid ejecting head 19 and other components, except for the transport belt 18. Accordingly, the following description will focus on the differences from the first embodiment.

Figure 6:
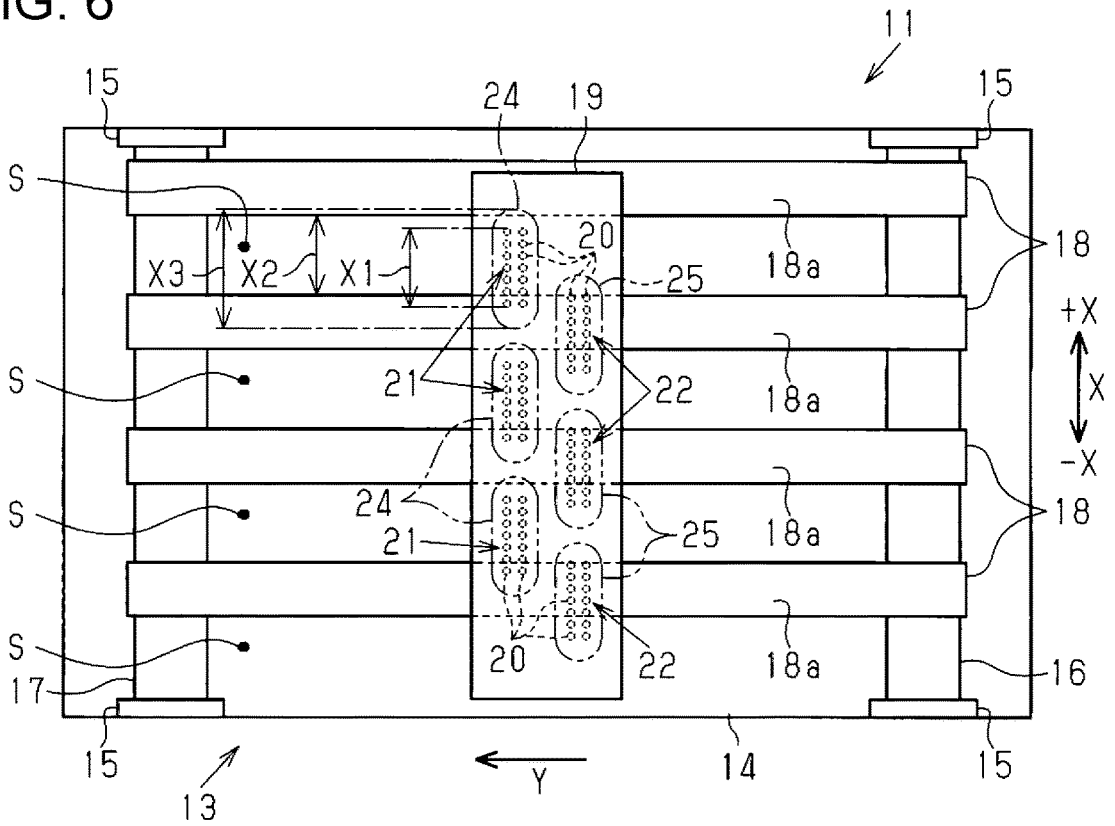
FIG. 6 is a schematic plan view showing a general configuration of a liquid ejecting apparatus according to a third embodiment.

As shown in FIG. 6, the transport belts 18 in the liquid ejecting apparatus 11 according to this embodiment are formed of a belt material having a length in the width direction X (belt width) slightly wider than the belt width of the narrow transport belt 18 of the first embodiment shown in FIG. 2. In this embodiment, accordingly, the length X1 of the three nozzle groups 21 (22) constituting the first nozzle group 21 (second nozzle group 22) is longer than the length X2 of the clearance S between the transport belts 18 adjacent to each other in the width direction X, unlike in the first embodiment. Therefore, as shown in FIG. 6, some of the nozzles 20 included in the first nozzle group 21, located close to the respective end portions of the nozzle rows extending in the width direction X, are located so as to oppose the transport belt 18, not the clearance S.

Accordingly, when the ink is discharged at a time from all the nozzles 20 of the first nozzle group 21 for the preliminary ejection, the ink discharged from some of the nozzles 20 is blocked by the transport belt 18 and disturbed from being received by the first cap 24. In this embodiment, therefore, when the preliminary ejection is performed the ink is sequentially discharged from the nozzles 20, from the nozzle that has reached the position deviated from the transport belt 18 while the transport belt 18 is being moved in the width direction X, instead of discharging the ink at a time from all of the nozzles 20 of the nozzle groups 21 and 22. Here, the length X2 of the clearance S between the transport belts 18 adjacent to each other in the width direction X is shorter than the length X3 of the opening of the first cap 24 (second cap 25) in the width direction X, as in the first embodiment.

When the preliminary ejection for the maintenance of the liquid ejecting head 19 is performed under the configuration according to this embodiment, the transport belt 18 is moved in the width direction X as follows, under the control of the control unit 27. First, the moving mechanism 26 moves the transport belt 18 in the width direction X, such that a plurality of nozzles 20 located on the side of an end portion (upper end portion in FIG. 6) of the nozzle row in the first nozzle group 21 are located above the clearance S between the transport belts 18 adjacent to each other in the width direction X, as shown in FIG. 6. At this point, the ink is discharged as waste liquid from the nozzles 20 located above the clearance S, which are deviated from the transport belt 18, onto the first cap 24 located thereunder, according to the control data from the control unit 27. In other words, the preliminary ejection is performed onto the first cap 24 only from the nozzles 20 deviated from the transport belt 18, out of all the nozzles 20 of the first nozzle group 21.

From the state shown in FIG. 6, the moving mechanism 26 moves the transport belts 18, together with the substrate 14, to the −X side in the width direction X under the control of the control unit 27. As result, some of the nozzles 20, thus far opposed to the transport belt 18 because of being located on the side of the other end portion (lower end portion in FIG. 6) of the nozzle row in the first nozzle group 21, sequentially reach the position above the clearance S, deviated from the transport belt 18. In addition, a plurality of nozzles 20 on the side of an end portion (upper end portion in FIG. 6) of the nozzle row in the second nozzle group 22 are sequentially located above the clearance S between the transport belts 18 adjacent to each other in the width direction X.

Figure 7:
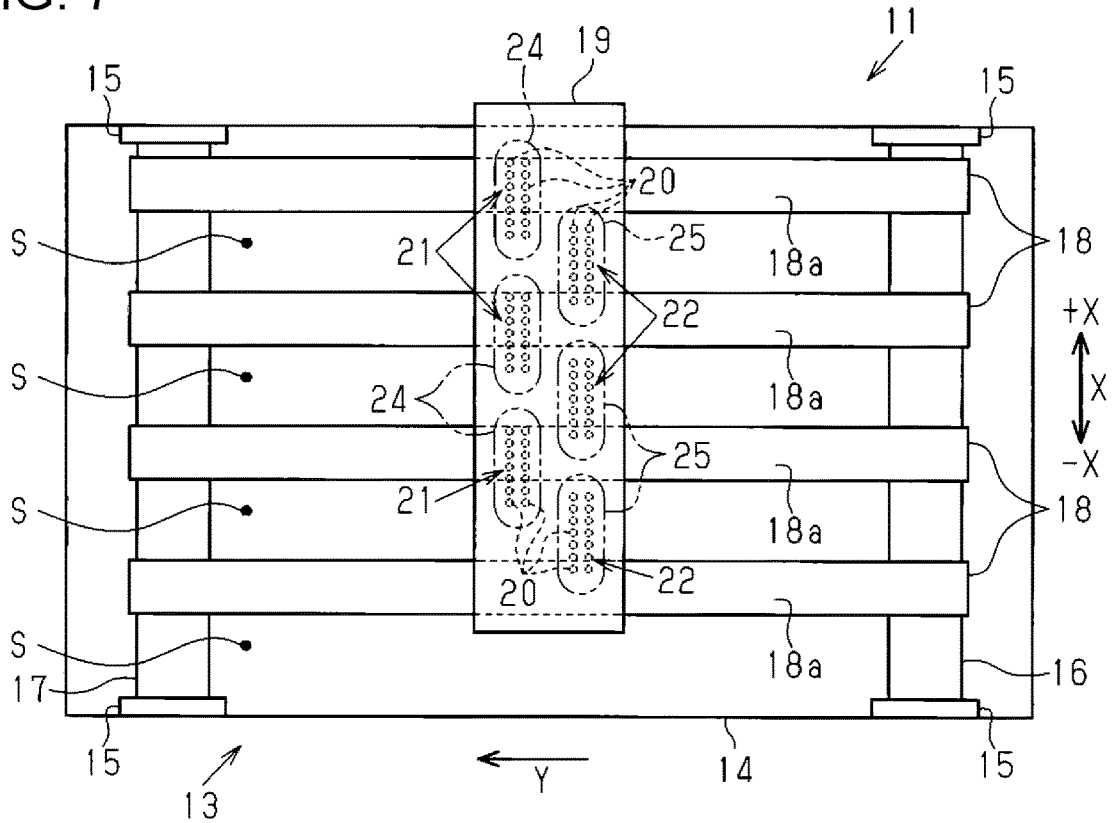
FIG. 7 is a plan view of the liquid ejecting apparatus, with the transport belts moved to the −X side from the state shown in FIG. 6.

Referring now to FIG. 7, the ink is discharged as waste liquid onto the first cap 24 and the second cap 25 located below, from the nozzles 20 of the first nozzle group 21 and the second nozzle group 22 that have sequentially reached the position above the clearance S, with the mentioned movement of the transport belt 18 in the width direction X. In other words, the preliminary ejection is sequentially performed, from the nozzles 20 displaced from the position opposite the transport belt 18 to the position deviated therefrom, simultaneously with the movement of the transport belt 18 in the width direction X.

When the transport belt 18 is further moved to the −X side in the width direction X from the state shown in FIG. 7, some of the nozzles 20, thus far opposed to the transport belt 18 because of being located on the side of the other end portion (lower end portion in FIG. 7) of the nozzle row in the second nozzle group 22, sequentially reach the position above the clearance S, deviated from the transport belt 18. Then, the ink is discharged as waste liquid onto the second cap 25 located below under the control of the control unit 27, from the nozzles 20 of the second nozzle group 22 that have sequentially reached the position above the clearance S, with the mentioned movement of the transport belt 18 in the width direction X. When the printing is to be resumed thereafter, the moving mechanism 26 moves the transport belt 18 to the +X side in the width direction X as in the first embodiment, and then the ink is ejected from the nozzles 20 of the nozzle groups 21 and 22 included in the liquid ejecting head 19, according to the print data, onto the recording sheet 12 transported in the transport direction Y.

The third embodiment provides the following advantageous effects, in addition to 1-1 provided by the first embodiment.

3-1

The preliminary ejection can be sequentially performed, from the nozzle 20 that has reached the position deviated from the transport belt 18, while causing the moving mechanism 26 to move the transport belt 18 in the width direction X. Therefore, the time required for the maintenance can be further shortened.

The foregoing embodiments may be modified as variations described hereunder. The configurations according to any of the embodiments and the variations may be combined as desired, and also the configurations according to any of the following variations may be combined as desired.

Figure 8:
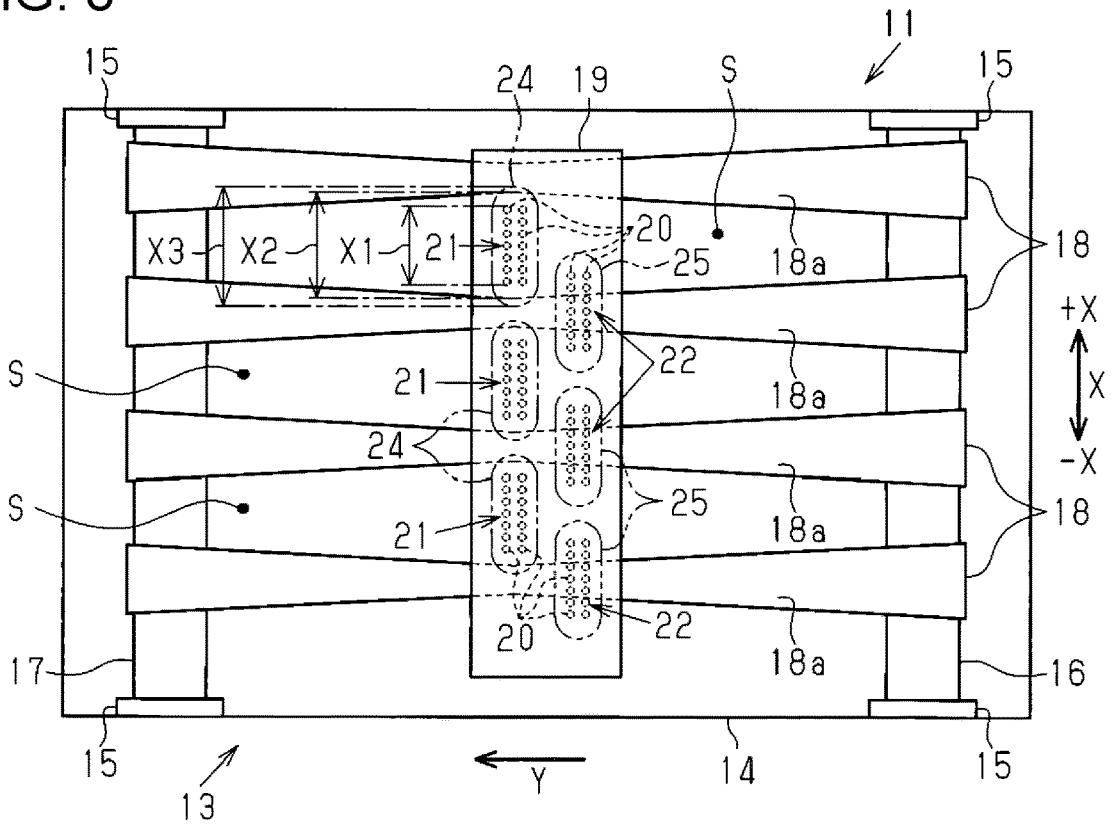
FIG. 8 is a schematic plan view showing a general configuration of a liquid ejecting apparatus according to a variation 1.

FIG. 8 illustrates a variation 1, in which the transport belts 18 are each formed of a belt material including a narrower portion and a wider portion, instead of having a constant length in the width direction X (belt width), along the transport direction Y. Accordingly, the length X2 of the clearance S between the transport belts 18 adjacent to each other in the width direction X becomes longer than the length X1 of the nozzle groups 21 and 22 in the width direction X, at the narrower portion of the transport belt 18, and therefore the preliminary ejection can be performed from the nozzles 20 of the nozzle groups 21 and 22 located between the respective narrower portions. In this case, since a part of the transport belt 18 is wider, the durability of the transport belt 18 can be improved.

Figure 9:
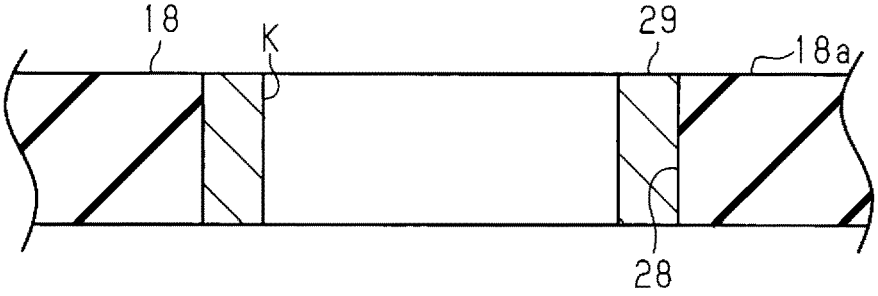
FIG. 9 is a schematic partial cross-sectional view showing a transport belt in a liquid ejecting apparatus according to a variation 2.

FIG. 9 illustrates a variation 2, in which a rigid body 29, formed of a resin or a metal in a frame shape that defines the opening K, is fitted in a hole 28 formed in the transport belt 18, in the case of forming the opening K in the transport belt 18 for the purpose of the preliminary ejection. In this case, the opening K defined by the rigid body 29 is exempted from being deformed, despite the transport belt 18 being subjected to a tension, and therefore the transport belt 18 can be prevented from being deformed owing to the presence of the opening K, unlike the case where the opening K is directly formed in the transport belt 18.

Figure 10:
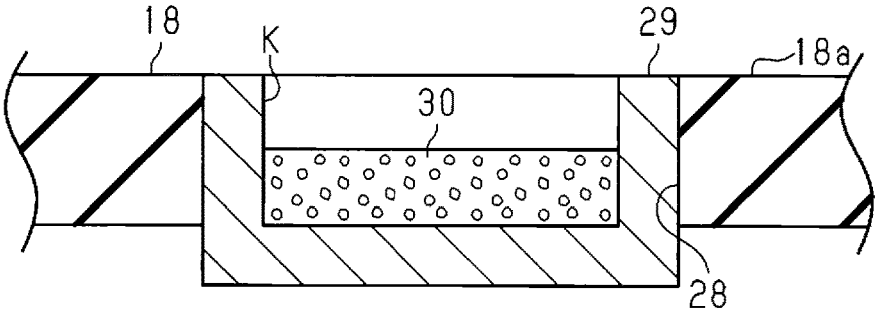
FIG. 10 is a schematic partial cross-sectional view showing a transport belt in a liquid ejecting apparatus according to a variation 3.

FIG. 10 illustrates a variation 3, in which the rigid body 29 fitted in the hole 28 formed in the transport belt 18 has a bottomed cylindrical shape. In other words, the rigid body 29 of the bottomed cylindrical shape also serves as the cap 24 or 25. In this case, further, it is preferable to provide an absorber 30 capable of absorbing and retaining the ink discharged as waste liquid, on the bottom portion of the opening K, constituted of the rigid body 29 of the bottomed cylindrical shape. In this case, since the rigid body 29 defining the opening K also serves as the cap 24 or 25, which is the maintenance component, the number of parts can be reduced. In addition, the presence of the absorber 30 on the bottom portion of the opening K defined by the rigid body 29 prevents the ink discharged as waste liquid from flowing out from the opening K, when the transport belt 18 is made to rotate.

Figure 11:
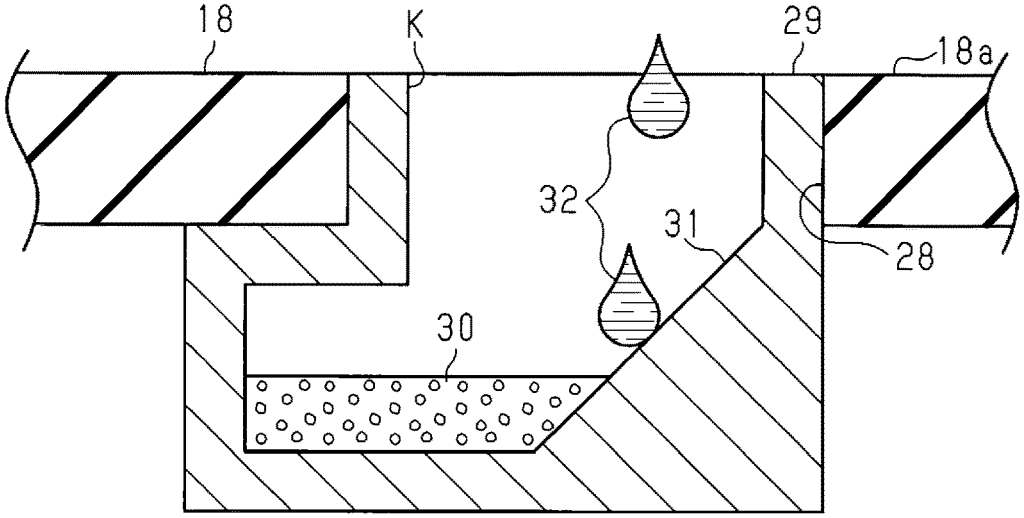
FIG. 11 is a schematic partial cross-sectional view showing a transport belt in a liquid ejecting apparatus according to a variation 4.

FIG. 11 illustrates a variation 4, in which a sloped surface 31 is formed on an inner wall of the opening K, defined by the rigid body 29 fitted in the hole 28 of the transport belt 18. Such a configuration facilitates ink droplets 32 discharged into inside of the opening K from the nozzle 20 to be conducted to the bottom portion along the sloped surface 31, thereby preventing the ink droplets 32 from popping out of the opening K and splashing around. In this case, it is preferable to provide the absorber 30 on the bottom portion of the opening K.

Figure 12:
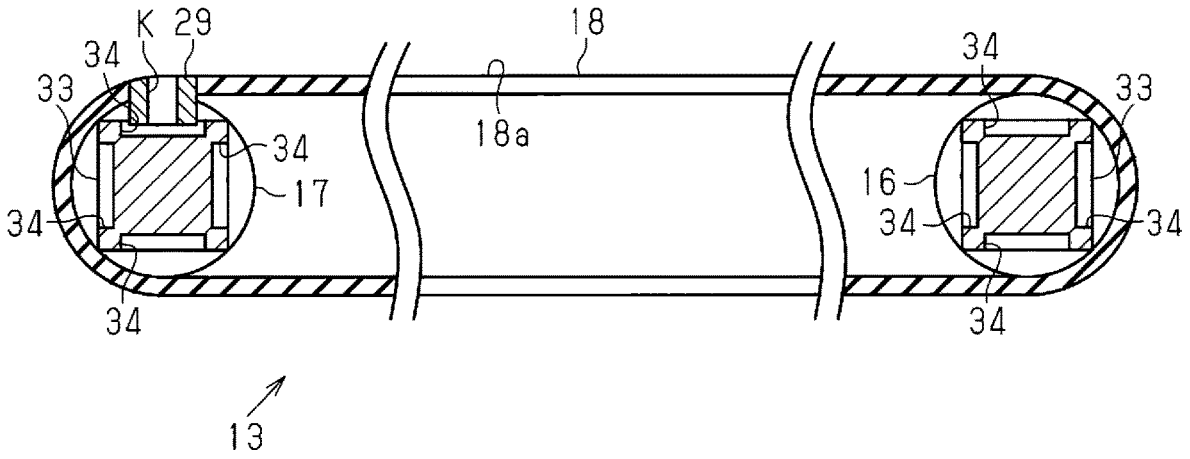
FIG. 12 is a schematic partial cross-sectional view showing a transport belt in a liquid ejecting apparatus according to a variation 5.

FIG. 12 illustrates a variation 5, in which the drive roller 16 and the slave roller 17, with which the transport belt 18 is engaged, each include a polygonal column portion 33 having a polygonal, for example a square cross-sectional shape, and formed at least at a position in the width direction X corresponding to the rigid body 29 defining the opening K. In addition, the circumferential surface of the polygonal column portion 33 of the rollers 16 and 17 may include a groove 34, for the bottom portion of the rigid body 29 defining the opening K to be fitted in. In the case where, for example, a round roller having a circular cross-section is employed, the transport belt 18 may exhibit an irregular behavior when the portion of the transport belt 18 where the rigid body 29 is provided is engaged with the circumferential surface of the roller. With the configuration according to the variation 5, in contrast, since the rigid body 29 is fitted in the groove 34 formed in the polygonal column portion 33 of the roller, the irregular behavior of the transport belt 18 can be prevented.

Alternatively, the groove 34 may be formed in the outer circumferential surface of the rollers 16 and 17, to receive the rigid body 29 defining the opening K. In this case also, the same advantageous effects as above can be attained.

Figure 13:
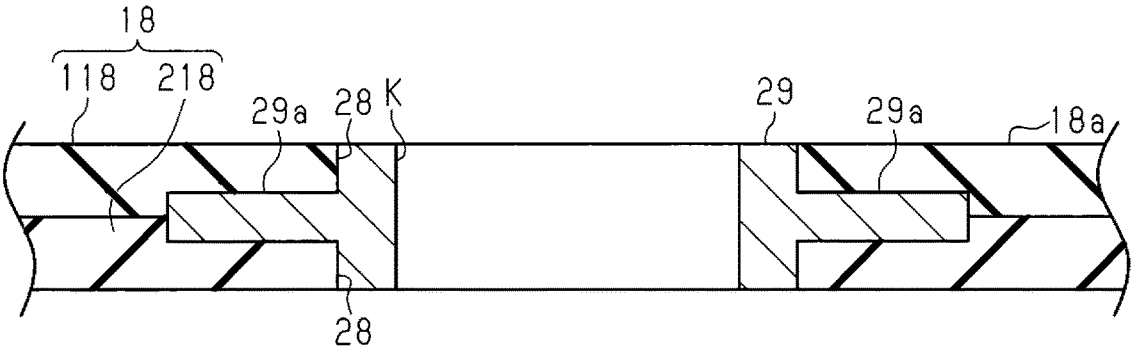
FIG. 13 is a schematic partial cross-sectional view showing a transport belt in a liquid ejecting apparatus according to a variation 6.

FIG. 13 illustrates a variation 6, in which the transport belt 18 has a dual layer structure including an outer belt 118 and an inner belt 218 stacked in the thickness direction, and the rigid body 29 defining the opening K includes a flange 29*a* formed around the lateral face, and is interposed between the outer belt 118 and the inner belt 218, via the flange 29*a*. Holding thus the rigid body 29 with the two-layered transport belt 18 minimizes a protrusion originating from the rigid body 29, and thereby allows the groove 34 of the variation 5 to be formed in a reduced depth, or the roller to be formed in a reduced diameter.

In the case where the control unit 27 identifies in advance one of the nozzle groups 21 and 22 included in the liquid ejecting head 19, including a relatively larger number of nozzles 20 uninvolved in the printing based on the print data received, the control unit 27 may move the transport belt 18 in the width direction X, before the recording sheet 12 is transported, such that the one of the nozzle groups 21 and 22 is located at a position deviated from the transport belt 18.

In this case, the recording sheet 12 is transported for the printing, after the transport belt 18 is moved in advance such that the nozzle group 21 or 22, including a relatively larger number of the nozzles 20 uninvolved in the printing, is located at the position deviated from the transport belt 18. Such an arrangement eliminates the need to move the transport belt 18 in the event of the first maintenance work after the start of the printing, to thereby minimize the decline in throughput, to the corresponding extent.

The control unit 27 may have a function to detect a thickening level of the ink in each of the plurality of nozzles 20. Specifically, the control unit 27 may be configured to decide whether the ink in the nozzle 20 has been thickened, for example by activating a driving element for ejecting the ink from the nozzle 20 (e.g., piezoelectric element) to such an extent as keeping the ink from being ejected from the nozzle 20, and detecting residual vibration of the cavity. The control unit 27 may then control the moving mechanism 26, on the basis of the decision result, so as to locate the nozzle groups 21 and 22 including one or more nozzles 20 in which the thickening level of the ink has exceeded a threshold, out of the nozzle groups 21 and 22 included in the liquid ejecting head 19, at a position deviated from the transport belt 18.

The mentioned arrangement reduces the number of times of the preliminary ejection, compared with, for example, the case where the preliminary ejection is performed each time a predetermined time elapses, irrespective of the thickening level, to thereby minimize the decline in throughput, to the corresponding extent.

In the liquid ejecting head 19, the first nozzle group 21 and the second nozzle group 22 may be shifted from each other only in the width direction X so as to be alternately located, instead of both in the width direction X and in the transport direction Y. In this case also, the same advantageous effect as 1-1 provided by the first embodiment can be attained.

One or more boxes for the preliminary ejection may be separately provided, in addition to the caps 24 and 25.

The opening K provided in the transport belt 18 for the purpose of the preliminary ejection may be formed in a different shape from rectangular, such as elliptical or circular, provided that the ink discharged from the nozzles 20 of the nozzle groups 21 and 22 can pass therethrough.

A cap material may be provided at a position aligned with the liquid ejecting head 19 in the transport direction Y, so as to be moved to a position opposite the nozzle 20 of the liquid ejecting head 19 and make close contact with the liquid ejecting head 19. Alternatively, a plate member may be provided at a position aligned with the liquid ejecting head 19 in the transport direction Y, so as to be moved to a position opposite the nozzle 20 of the liquid ejecting head 19, and the liquid ejecting head 19 may include an elastic member that can make close contact with the plate member. In either case, a material that can make close contact with the liquid ejecting head 19 can be obtained, without incurring an increase in size.

The recording sheet (medium) 12 may be adsorbed to the transport belt 18, by means of suction. In this case, a suction unit for adsorbing the recording sheet 12 to the transport belt 18 may also be activated during the preliminary ejection, so as to collect mist.

When continuous printing is performed, it is preferable to move the transport belt 18 in the width direction X, between the recording sheets 12 being transported. It is more preferable, in this case, to determine the distance between the drive roller 16 and the slave roller 17 according to the length of the most frequently used recording sheets, because the degradation in throughput can be prevented.

In the second embodiment, the transport belt 18 is made to move in the direction opposite to the transport direction Y of the recording sheet 12, before the ink is discharged to the second cap 25 from the nozzles 20 of the second nozzle group 22. However, the transport belt 18 may be moved forward in the transport direction Y, before the discharging. In this case, the control of the drive roller 16 can be prevented from being complicated.

Although the transport belt 18 is moved both ways in the width direction X before the printing is resumed, in the foregoing embodiments, the printing may be resumed after the transport belt 18 is moved one way in the width direction X. Such an arrangement suppresses the degradation in throughput, compared with the case of resuming the printing after moving the transport belt 18 both ways in the width direction X.

The liquid to be ejected by the liquid ejecting head 19 is not limited to the ink but may be, for example, a fluid containing particles of a functional material dispersed or mixed therein. Alternatively, for example, a fluid containing, dispersed or dissolved therein, an electrode material or color material (pixel material) used for manufacturing a liquid crystal display, an electroluminescence (EL) display, or a field-emission display, may be employed as the liquid to be ejected for recording.

The medium may be, for example, a plastic film or a thin plate material, or a fabric used for a textile printing apparatus, without limitation to the recording sheet. Further, the medium may be clothing of a desired shape, such as a T-shirt, or a three-dimensional object of a desired shape, such as tableware or stationery.

Hereunder, technical ideas that can be reached on the basis of the foregoing embodiments and the variations thereof, as well as the advantageous effects thereby provided, will be described.

Idea 1

A liquid ejecting apparatus including:

a liquid ejecting head that prints an image on a medium, by ejecting a liquid through a plurality of nozzles according to print data;

a transport belt that transports the medium by moving in a transport direction of the medium, at a position opposite the liquid ejecting head;

a moving mechanism configured to move at least one of the liquid ejecting head and the transport belt in a width direction intersecting the transport direction; and a control unit that controls the moving mechanism, wherein the liquid ejecting head includes a first nozzle group including a plurality of the nozzles, and a second nozzle group including another plurality of the nozzles different from the nozzles of the first nozzle group, and wherein the control unit controls the moving mechanism such that a nozzle group performing the preliminary ejection which is an ejection of the liquid not uninvolved in printing among the first nozzle group and the second nozzle group is located at a position not facing the transport belt, and a nozzle group that does not perform the preliminary ejection is located at a position facing the transport belt.

The mentioned configuration allows the preliminary ejection to be performed, simply by moving at least one of the liquid ejecting head and the transport belt in the width direction, so as to locate the nozzle group that performs the preliminary ejection, at a position deviated from the transport belt. More specifically, at the position opposite the transport belt, the preliminary ejection is unable to be performed onto the maintenance component such as the cap, because of the presence of the transport belt. However, at a position deviated from the transport belt, the preliminary ejection can be performed onto the maintenance component from the nozzle group. Therefore, the time required for the maintenance can be shortened, compared with the case where the entirety of the liquid ejecting head is moved, for the purpose of the preliminary ejection, in the width direction so that all the nozzle groups are moved from the position opposite the transport belt to the position on the outer side of the transport belt, thus to be deviated therefrom. In addition, the foregoing liquid ejecting apparatus does not include the upstream transport belt and the downstream transport belt, which are shifted from each other in the transport direction, and therefore an increase in dimensions of the apparatus as a whole can be suppressed.

Idea 2

The liquid ejecting apparatus according to the idea 1, wherein a plurality of the transport belts are aligned in the width direction, with a predetermined clearance therebetween, wherein a plurality of the first nozzle groups and a plurality of the second nozzle groups are alternately located in the width direction, and wherein the control unit controls the moving mechanism such that the nozzle group performing the preliminary ejection among the first nozzle group and the second nozzle group is located at a position facing the clearance, and a nozzle group that does not perform the preliminary ejection is located at a position facing the transport belt.

The mentioned configuration allows the preliminary ejection to be performed, simply by moving at least one of the liquid ejecting head and the transport belt in the width direction, so as to locate the nozzle group that performs the preliminary ejection at the position opposite the clearance between the transport belts adjacent to each other in the width direction. In other words, it suffices to move the nozzle group, located at the position opposite the transport belt before the preliminary ejection, by a short distance to the position opposite the clearance between the transport belts adjacent to each other in the width direction. Such an arrangement further shortens the time required for the maintenance.

Idea 3

The liquid ejecting apparatus according to the idea 1, wherein the transport belt includes a plurality of openings formed along the width direction with a predetermined clearance therebetween, wherein a plurality of the first nozzle groups and a plurality of the second nozzle groups are alternately located in the width direction, and wherein the control unit controls the moving mechanism such that the nozzle group performing the preliminary ejection among the first nozzle group and the second nozzle group is located at a position facing the openings, and a nozzle group that does not perform the preliminary ejection is located at a position facing the transport belt.

The mentioned configuration allows the preliminary ejection to be performed, simply by moving at least one of the liquid ejecting head and the transport belt in the width direction, so as to locate the nozzle group that performs the preliminary ejection at the position opposite the opening of the transport belt. In other words, it suffices to move the nozzle group, located at the position opposite the transport belt and deviated from the opening before the preliminary ejection, to the position opposite the opening, by a short distance in the width direction within the width of the transport belt. Such an arrangement further shortens the time required for the maintenance.

Idea 4

The liquid ejecting apparatus according to any one of the ideas 1 to 3, wherein, when at least one of the liquid ejecting head and the transport belt is moved in the width direction under control of the moving mechanism, the control unit sequentially performs the preliminary ejection from the nozzle that has reached a position not facing the transport belt among the plurality of nozzles.

The mentioned arrangement allows the nozzles to sequentially perform the preliminary ejection, from the nozzle that has reached the position deviated from the transport belt, while causing the moving mechanism to move at least one of the liquid ejecting head and the transport belt in the width direction. Therefore, the time required for the maintenance can be further shortened.

Idea 5

The liquid ejecting apparatus according to any one of the ideas 1 to 4, wherein the control unit controls the moving mechanism to move the transport belt in the width direction before the medium is moved by the transport belt such that one of the nozzle groups of the liquid ejecting head including a relatively larger number of the nozzles not use for the printing is located at a position not facing the transport belt.

In this case, the medium is transported for the printing, after the transport belt is moved in advance such that the nozzle group, including a relatively larger number of the nozzles uninvolved in the printing, is located at the position deviated from the transport belt. Such an arrangement eliminates the need to move the transport belt in the event of the first maintenance work after the start of the printing, to thereby minimize the decline in throughput, to the corresponding extent.

Idea 6

The liquid ejecting apparatus according to any one of the ideas 1 to 5, in which the control unit is configured to detect a thickening level of the liquid in each of the plurality of the nozzles, and to control the moving mechanism such that one of the nozzle groups of the liquid ejecting head including one or more nozzles in which the thickening level has exceeded a threshold is located at a position not facing the transport belt.

The mentioned arrangement reduces the number of times of the preliminary ejection, compared with, for example, the case where the preliminary ejection is performed each time a predetermined time elapses, irrespective of the thickening level, to thereby minimize the decline in throughput, to the corresponding extent.

The entire disclosure of Japanese Patent Application No. 2017-127038, filed Jun. 29, 2017 is expressly incorporated by reference herein.

What is claimed is:

1. A liquid ejecting apparatus comprising:

a liquid ejecting head that prints an image on a medium, by ejecting a liquid through a plurality of nozzles according to print data;

a plurality of transport belts that align in a width direction intersecting a transport direction of the medium and that transport the medium by moving in the transport direction, at a position opposite the liquid ejecting head;

a moving mechanism configured to move at least one of the liquid ejecting head and the transport belt in a width direction intersecting the transport direction; and a control unit that controls the moving mechanism, wherein each of the plurality of transport belts has a narrower portion and a wider portion, the narrower portion having a shorter length in the width direction than the wider portion, wherein the liquid ejecting head includes a first nozzle group including a plurality of the nozzles, and a second nozzle group including another plurality of the nozzles different from the nozzles of the first nozzle group, and wherein the control unit controls the moving mechanism such that a nozzle group performing the preliminary ejection which is an ejection of the liquid not uninvolved in printing among the first nozzle group and the second nozzle group is located at a position not facing the transport belt.

2. The liquid ejecting apparatus according to claim 1, wherein a plurality of the transport belts are aligned in the width direction, with a predetermined clearance therebetween, wherein a plurality of the first nozzle groups and a plurality of the second nozzle groups are alternately located in the width direction, and wherein the control unit controls the moving mechanism such that the nozzle group performing the preliminary ejection among the first nozzle group and the second nozzle group is located at a position facing the clearance.

3. The liquid ejecting apparatus according to claim 1, wherein, when at least one of the liquid ejecting head and the transport belt is moved in the width direction under control of the moving mechanism, the control unit sequentially performs the preliminary ejection from the nozzle that has reached a position not facing the transport belt among the plurality of nozzles.

4. The liquid ejecting apparatus according to claim 1, wherein the control unit controls the moving mechanism to move the transport belt in the width direction before the medium is moved by the transport belt such that one of the nozzle groups of the liquid ejecting head including a relatively larger number of the nozzles not use for the printing is located at a position not facing the transport belt.

5. The liquid ejecting apparatus according to claim 1, wherein the control unit is configured to detect a thickening level of the liquid in each of the plurality of the nozzles, and to control the moving mechanism such that one of the nozzle groups of the liquid ejecting head including one or more nozzles in which the thickening level has exceeded a threshold is located at a position not facing the transport belt.

* * * * *